US007641420B2

(12) United States Patent
Becker et al.

(10) Patent No.: US 7,641,420 B2
(45) Date of Patent: Jan. 5, 2010

(54) RESIDENTIAL SEALCOATING MACHINE HAVING CLEANABLE MANIFOLD

(76) Inventors: Gerald R. Becker, 24775 Pine Ridge Rd., Pierz, MN (US) 56364; Audrey M. Becker, 24775 Pine Ridge Rd., Pierz, MN (US) 56364

( * ) Notice: Subject to any disclaimer, the term of this patent is extended or adjusted under 35 U.S.C. 154(b) by 532 days.

(21) Appl. No.: 11/594,006

(22) Filed: Nov. 7, 2006

(65) Prior Publication Data

US 2007/0104537 A1 May 10, 2007

Related U.S. Application Data

(60) Provisional application No. 60/734,167, filed on Nov. 7, 2005.

(51) Int. Cl.
*E01C 19/16* (2006.01)

(52) U.S. Cl. ..... 404/107; 404/111

(58) Field of Classification Search ..... 404/93, 404/94, 107, 108, 111; 239/147, 172
See application file for complete search history.

(56) References Cited

U.S. PATENT DOCUMENTS

| | | | | | |
|---|---|---|---|---|---|
| 1,052,578 | A | * | 2/1913 | Fitzgerald | 404/107 |
| 3,533,336 | A | | 10/1970 | Wikel | |
| 3,703,856 | A | | 11/1972 | Wikel et al. | |
| 3,841,779 | A | | 10/1974 | Ray | |
| 3,940,213 | A | | 2/1976 | Smith | |
| 3,946,722 | A | * | 3/1976 | Banahan | 126/343.5 A |
| 3,989,403 | A | | 11/1976 | Verive | |
| 4,026,658 | A | | 5/1977 | Neuendorf et al. | |
| 4,159,877 | A | * | 7/1979 | Jacobson et al. | 366/22 |
| D257,149 | S | * | 9/1980 | Jacobson | D15/27 |
| 4,302,128 | A | | 11/1981 | Thatcher | |
| 4,315,700 | A | | 2/1982 | Heiligtag et al. | |
| 4,535,920 | A | * | 8/1985 | Troup | 222/612 |
| 4,575,279 | A | | 3/1986 | Mateja | |
| 4,688,964 | A | | 8/1987 | Cox | |
| D298,946 | S | * | 12/1988 | Schave et al. | D15/13 |
| 4,831,958 | A | | 5/1989 | Selby | |
| 5,325,994 | A | * | 7/1994 | Mizialko et al. | 222/54 |
| 5,362,178 | A | | 11/1994 | Schantz | |
| 5,549,457 | A | | 8/1996 | Flores et al. | |
| 5,735,952 | A | | 4/1998 | Wilson, Sr. | |
| 5,832,178 | A | * | 11/1998 | Schave | 392/472 |
| 5,974,227 | A | * | 10/1999 | Schave | 392/478 |
| 6,049,658 | A | * | 4/2000 | Schave et al. | 392/472 |
| 6,102,615 | A | | 8/2000 | Wilson, Sr. | |
| 6,109,826 | A | * | 8/2000 | Mertes | 404/95 |
| 6,290,428 | B1 | | 9/2001 | Hall et al. | |

* cited by examiner

*Primary Examiner*—Gary S Hartmann
(74) *Attorney, Agent, or Firm*—Patterson, Thuente, Skaar & Christensen, P.A.

(57) ABSTRACT

A towable, residential sealcoating apparatus and related methods for applying sealcoat to a residential, asphalt driveway. The towable, residential sealcoating apparatus can include a towable implement having a mounting frame, a sealcoat reservoir, a distribution manifold and an applicator member. The sealcoat reservoir can supply sealcoat to the distribution manifold and applicator member at the direction of a supply valve accessible to an operator on a tow vehicle. The applicator member can be vertically adjustable from an upward transport disposition to a downward application disposition. The distribution manifold is operably removable so as to allow for cleaning of the distribution manifold following completion of the sealcoating process.

7 Claims, 4 Drawing Sheets

RESIDENTIAL SEALCOATING MACHINE HAVING CLEANABLE MANIFOLD

PRIORITY CLAIM

The present application claims priority to U.S. Provisional Application Ser. No. 60/734,167 filed Nov. 7, 2005, and entitled "RESIDENTIAL SEALCOATING MACHINE HAVING CLEANABLE MANIFOLD", which is herein incorporated by reference in its entirety.

FIELD OF THE INVENTION

The invention relates generally to seal coating machines for applying sealant to an asphalt surface. More specifically, the invention is directed to a towable seal coating machine having a removable distribution manifold for easy cleaning of the manifold following application of the sealant to a residential asphalt surface.

BACKGROUND OF THE INVENTION

Asphalt is used for constructing a large percentage of the paved roadways, parking lots and residential driveways in the United States. Asphalt generally comprises a combination of aggregates (crushed stone and sand), filler (cement, hydrated lime or stone dust) and a bituminous binder (called asphalt cement or asphalt binder). When used in construction, asphalt has a number of advantages including smoothness when applied, ease of construction and durability. While asphalt construction has a number of advantages, asphalt can begin to break down due to oxidation, exposure to ultraviolet rays and exposure to oil and gas spills. As such, asphalt maintenance is important and especially so for residential homeowners that can incur significant expense due to damaged asphalt driveways.

The most common form of asphalt maintenance is the application of an asphalt sealant or sealcoat applied in a thin layer directly on the asphalt surface. Application of sealcoat provides a number of benefits including protecting the asphalt from exposure to oxygen and water, preventing ultraviolet rays from penetrating the asphalt, resisting damage caused by oil or gas spills, smoothing the asphalt surface and restoring the original look and color of the asphalt.

Depending upon environmental conditions (sun exposure, temperature variation, amount of moisture) and traffic on the sealcoat, asphalt driveways may require the application of sealcoat every 1 to 3 years. Sealcoat generally comprises a mixture of emulsified asphalt, water, mineral fillers and various other mixtures. Sealcoat can be applied using a squeegee, stiff broom or mechanical sprayers/applicators. Representative sprayers/applicators include those disclosed in U.S. Pat. Nos. 3,533,336; 3,703,856; 3,841,779; 3,940,213; 3,989,403; 4,026,658; 4,302,128; 4,315,700; 4,575,279; 4,688,964; 4,831,958; 5,362,178; 5,735,952; 5,549,457; 6,102,615; and 6,290,428, all of which are herein incorporated by reference.

Many homeowners apply sealcoat to their asphalt driveways themselves. While the sealcoating process can be successfully accomplished by homeowners, the process is generally messy and can destroy the brushes and components used in the sealcoating process. As such, it would be advantageous for residential homeowners to have an apparatus allowing for quick and efficient application of sealcoat while allowing for easy cleaning and maintenance of the apparatus.

SUMMARY OF THE INVENTION

The invention addresses the aforementioned needs by providing a residential sealcoat applicator apparatus that quickly and efficiently applies sealcoat and is easily cleanable upon completion of the sealcoating process.

In one aspect, a representative embodiment of a sealcoating apparatus comprises a towable implement having a mounting frame, a sealcoat reservoir, a distribution manifold and an applicator member. The sealcoat reservoir can supply sealcoat to the distribution manifold and applicator member at the direction of a supply valve accessible to an operator on a tow vehicle. The applicator member can be vertically adjustable from an upward transport disposition to a downward application disposition through use of a manually adjusted repositionable wheel assembly. The distribution manifold is operably removable so as to allow for cleaning of the distribution manifold following completion of the sealcoating process.

In another aspect, a residential sealcoating process can be accomplished utilizing a towable sealcoating apparatus that is disassemblable for cleaning upon completion of the sealcoating process. The sealcoating process can include supplying liquid sealcoat to an asphalt surface through a distribution manifold that generally evenly distributes sealcoat for application with an applicator member. A repositionable wheel assembly can be adjusted so as to vary the position of the applicator member between an upward transport disposition and a downward application disposition. Upon completion of the sealcoating process, the distribution manifold can be removed and cleaned allowing the towable sealcoating apparatus to be successfully used for subsequent sealcoating applications.

The above summary of the various embodiments of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
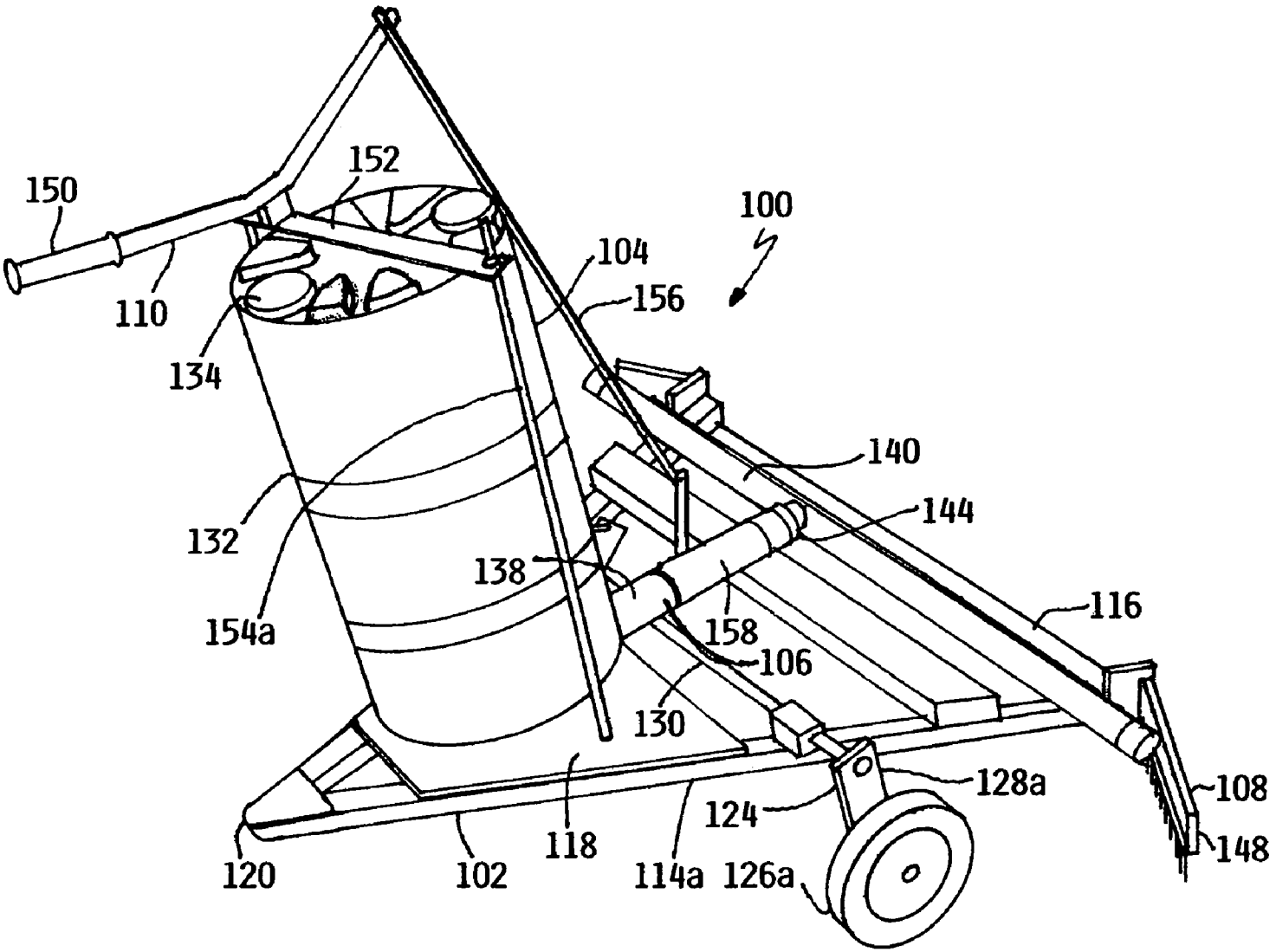
FIG. 1 is a perspective view an embodiment of a residential sealant applicator of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

Figure 2:
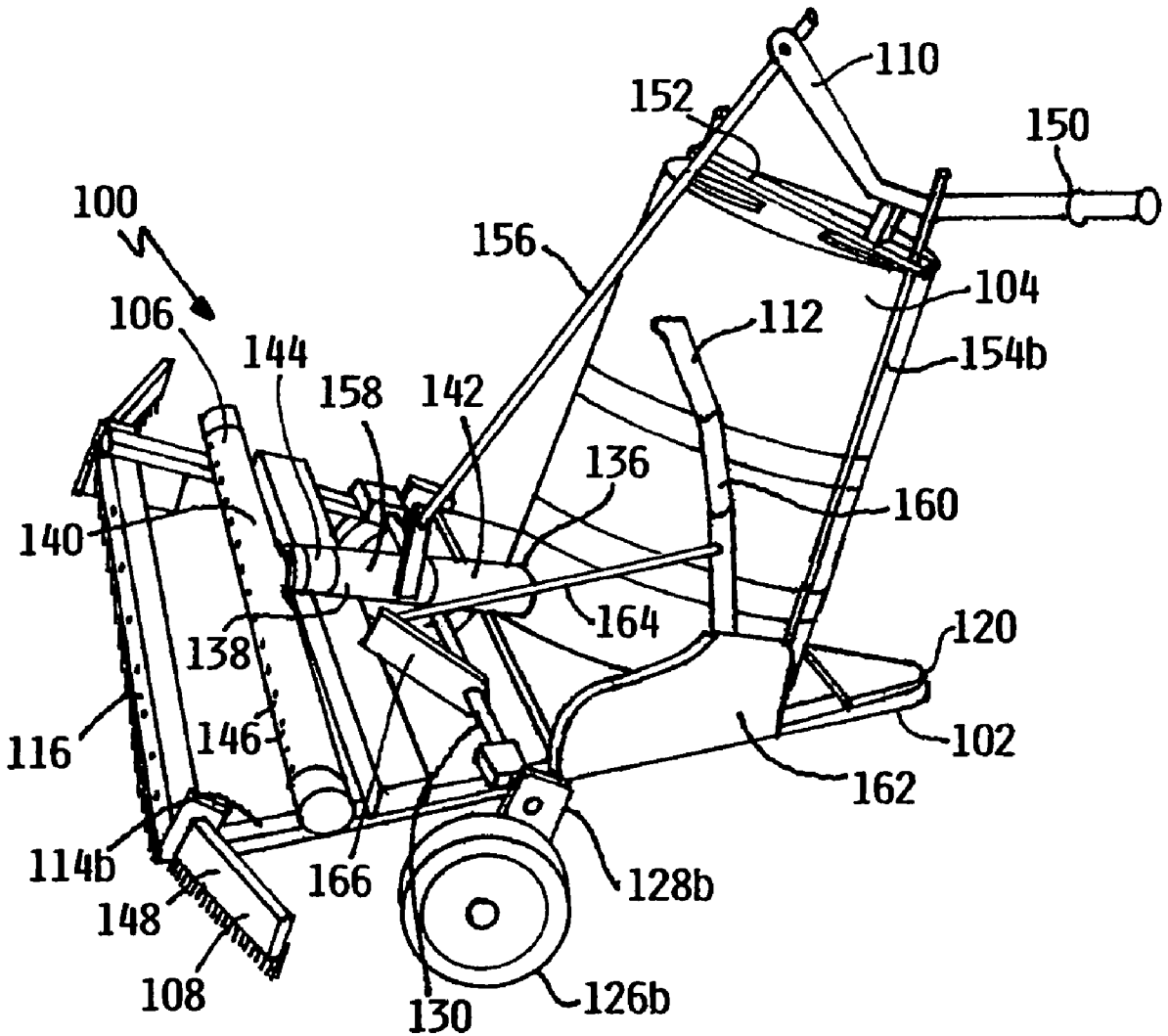
FIG. 2 is a perspective view of the residential sealant applicator of FIG. 1.
Figure 3:
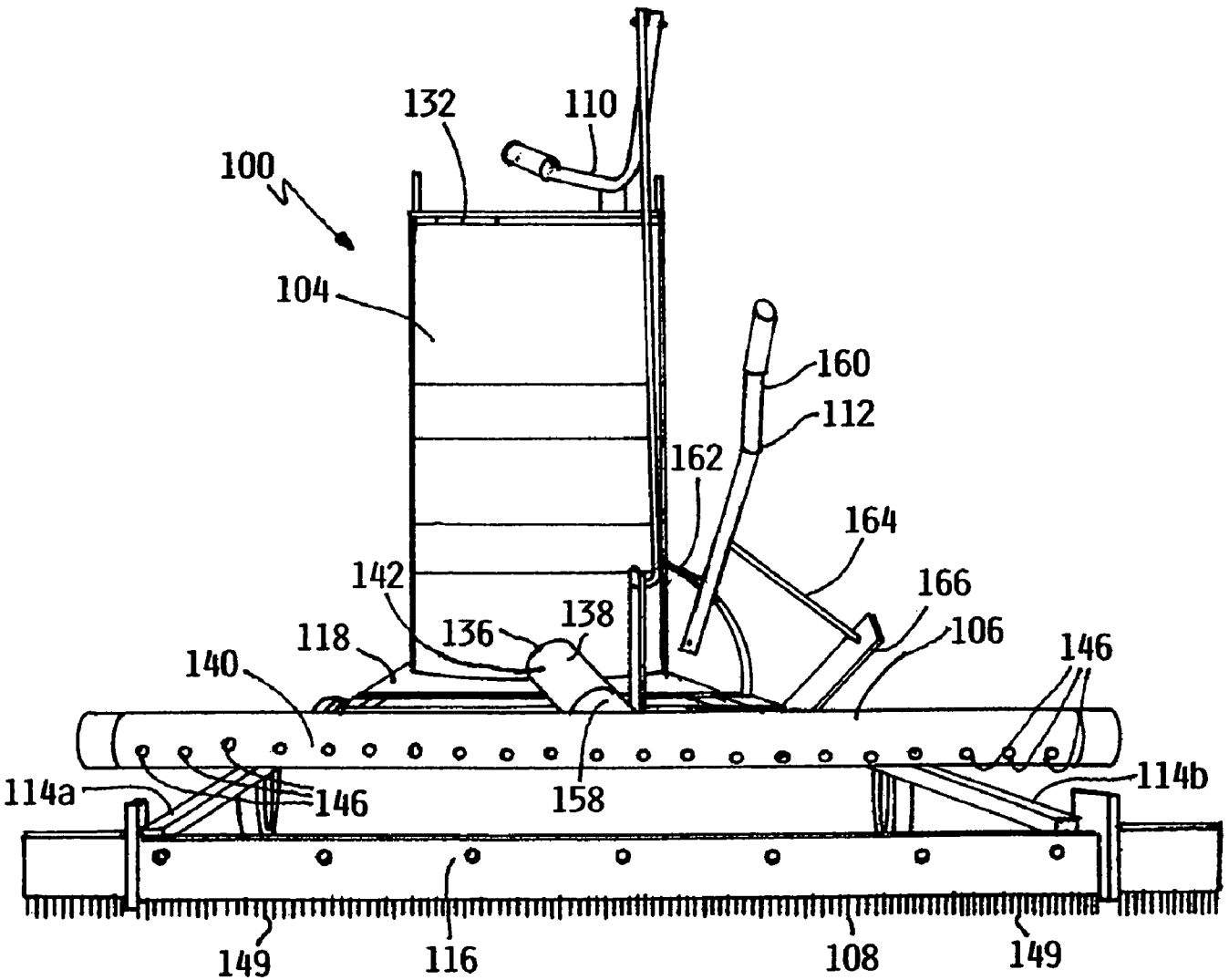
FIG. 3 is a perspective view of the residential sealant applicator of FIG. 1.

As illustrated in FIGS. 1, 2 and 3, a towable sealcoating apparatus 100 of the present invention can comprise a towable frame 102, a sealcoat reservoir 104, a distribution manifold 106 and an applicator member 108. Operation of towable sealcoating apparatus 100 can be controlled by a sealcoat delivery control 110 and an applicator position control 112. The components of the towable sealcoating apparatus 100 can be permanently attached such as, for example, by welding the components together. Alternatively, the components of the towable sealcoating apparatus 100 can be disassembled using suitable fasteners such as, for example, nuts and bolts, cotter pins and similar connectors, to promote ease of shipping and assembly of the towable sealcoating apparatus 100.

Towable frame 102 can comprise a pair of side members 114*a*, 114*b* and an end member 116. Side members 114*a*, 114*b* and end member 116 can be fabricated of suitable materials such as, for example, carbon steel and aluminum channel. Side members 114*a*, 114*b* and end members 116 can be attached using suitable attachment methods such as, for example, welding or using connectors such as nuts and bolts. A mounting floor 118 is mountably attached between side members 114*a*, 114*b*. Towable frame 102 can further comprise a towing receiver 120 and a repositionable wheel assembly 124. Towing receiver 120 can comprise any of a variety of suitable towing receiver configurations include a ball receiver, a 3-point hitch and a drawbar hitch. Repositionable wheel assembly 124 can comprise a pair of wheels 126*a*, 126*b*, a pair of extension members 128*a*, 128*b* and a mounting member 130.

Sealcoat reservoir 104 comprises a tank assembly 132 having an inlet port 134 and an outlet port 136. Tank assembly 132 can be constructed of suitable materials such as, for example, suitable plastics and metals. Tank assembly 132 is operably mounted to the mounting floor 118.

Distribution manifold 106 can comprise a supply portion 138 and a distribution portion 140. Distribution manifold 106 can be constructed of suitable materials such as, for example, PVC pipe. Supply portion 138 includes a supply end 142 and a distribution end 144. Distribution portion 140 includes a plurality of distribution bores 146 generally evenly spaced across the length of distribution portion 140.

Applicator member 108 can comprise a suitable applicator such as, for example, a squeegee 148 or alternatively, a brush 149, operably attached to the end member 116 and preferably extending beyond the side members 114*a*, 114*b*.

Sealcoat delivery control 110 can comprise a delivery lever 150, a delivery bracket 152, a pair of bracket mounts 154*a*, 154*b*, a lever arm 156 and a delivery valve 158. Delivery bracket 152 can be mounted over tank assembly 132 using bracket mounts 154*a*, 154*b* attached to the towable frame 102. Delivery valve 158 is fluidly, operably mounted within the supply portion 138. Delivery lever 150 operably connects to delivery valve 158 with lever arm 156.

Applicator position control 112 can comprise a positioning arm 160, a positioning bracket 162, an adjustment arm 164 and an attachment arm 166. Positioning arm 160 is rotatably attached to the positioning bracket 162 wherein the positioning bracket 162 is coupled to the towable frame 102 using a suitable attachment method such as, for example, welding, bolting and the like. Adjustment arm 164 is attached to the positioning arm 160 on one end and to the attachment arm 166 at the other end. Attachment arm 166 further attaches directly to the mounting member 130.

Figure 4:
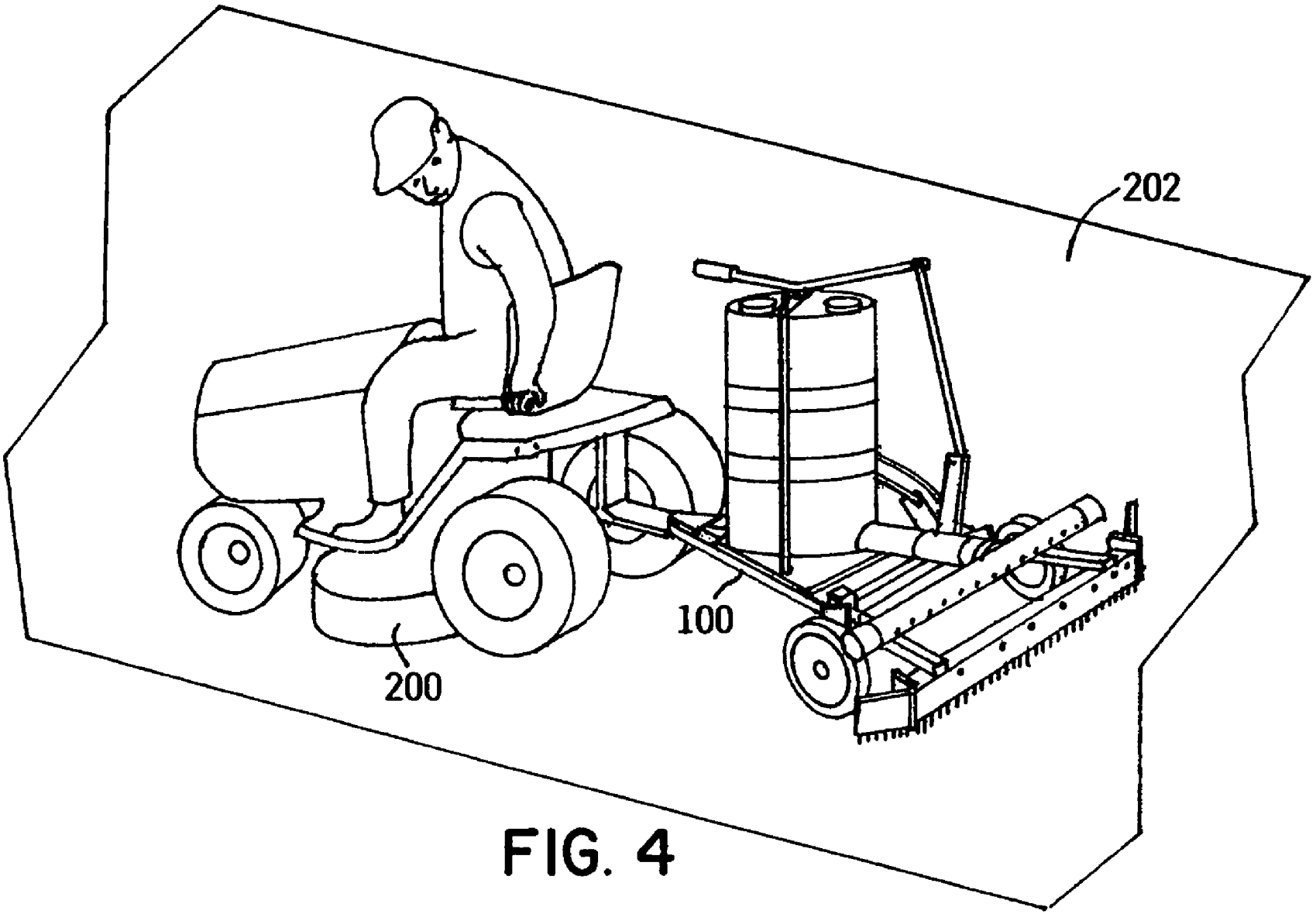
FIG. 4 is a perspective view the residential sealant applicator of FIG. 1 applying an asphalt sealant to a residential, asphalt surface.

As illustrated in FIG. 4, towable sealcoating apparatus 100 can be used with a suitable towing implement such as, for example, a lawn tractor 200 or all-terrain vehicle. Towable sealcoating apparatus 100 can be used to resurface and sealcoat an asphalt driveway 202. For example, towable sealcoating apparatus 100 can be attached to the lawn tractor 202 by positioning towing receiver 120 over a ball hitch on the lawn tractor 202. Wheels 126*a*, 126*b* are generally sized such that attachment of the towable sealcoating apparatus 100 to the lawn tractor 200 results in the towable sealcoating apparatus 100 being tilted such that the towing receiver 120 is at a higher elevation than the end member 116. When towable sealcoating apparatus 100 is in such tilted orientation as shown in FIG. 4, outlet port 136 is positioned so as gravity feed sealcoat into the supply portion 136 of distribution manifold 106.

In operation, an operator aligns lawn tractor 200, and consequently, towable sealcoating apparatus 100, with a portion of the asphalt driveway 202 in which, sealcoat is to be applied. The operator grasps the positioning arm 160 and pulls the positioning arm 160 toward the lawn tractor 200 which, causes adjustment arm 164 to pull the attachment arm 166 forward. As the attachment arm 166 is pulled toward the lawn tractor 200, mounting member 130 is caused to rotate such that the extension members 128*a*, 128*b* rotatably direct the wheels 126*a*, 126*b* toward the end member 116. As the extension members 128*a*, 128*b* are rotated, the ground clearance between the squeegee 148 and the driveway 202 is reduced until the squeegee 148 is in physical contact with the driveway 202.

The operator then opens delivery valve 158 by pulling delivery lever 150 toward the lawn tractor 200 such that the lever arm 156 actuates the delivery valve 158 to an open position. As delivery valve 156 is opened, sealcoat within tank assembly 130 begins flowing from outlet port 134 into supply end 140, through supply portion 136, out distribution end 142 and into distribution portion 138 due to the tilted configuration of the towable sealcoating apparatus 100. The sealcoat is flowably dispensed out the distribution bores 144 and onto the driveway 202. The operator directs the lawn tractor 200 forward such that the squeegee 148 comes into contact with and evenly spreads the sealcoat on the driveway 202. Preferably, squeegee 148 extends beyond the width of the lawn tractor 200 such that the operator can do a next pass on the driveway 202 without driving the lawn tractor 200 over previously applied sealcoat. Upon completion of the sealcoating process, the operator closes the delivery valve 156 by directing the delivery lever 150 away from the lawn tractor 200 and raises the squeegee 148 by directing the positioning arm 160 away from the lawn tractor 200.

Once the driveway 202 has been sealcoated, the distribution manifold 106 can be removed from the tank assembly 132, preferably by removing a quick connect or similar style fitting, that connects the supply end 142 to the outlet port 136. This allows for easy access and cleaning of the distribution manifold 106 and delivery valve 158 such that the towable sealcoating apparatus 100 can continue to be reused for subsequent sealcoat applications. In some embodiments, supply portion 136 and distribution portion 140 can be detachably removed from the delivery valve 158 to provide individual cleaning and maintenance access to each component. In addition, portions of the distribution manifold 106 can comprise flexible tubing/hose allowing for flexibility and quick connection of the components using connectors such as, for example, barbed fittings and/or hose clamps.

Although various embodiments of the invention have been disclosed here for purposes of illustration, it should be understood that a variety of changes, modifications and substitutions may be incorporated without departing from either the spirit or scope of the invention.

The invention claimed is:

1. A residential sealcoat application system comprising:

a towing implement including a towing member; and a tow-behind sealcoat apparatus having a towing receiver, a sealcoat reservoir, a repositionable wheel assembly, a distribution manifold, an applicator member and a driver-accessible delivery control;

wherein the towing member is operably interconnected with the towing receiver such that the towing implement can operably position the tow-behind sealcoat apparatus for application of sealcoat to an asphalt surface;

wherein the repositionable wheel assembly includes a driver accessible delivery lever for pivoting the repositionable wheel assembly so as to simultaneously position the sealcoat reservoir for gravity dispensing of seal coat while the applicator member is positioned against the asphalt surface; and wherein operation of the driver accessible delivery control releases sealcoat from the sealcoat reservoir through the distribution manifold and onto the asphalt surface, wherein the applicator member spreads the sealcoat across the asphalt surface.

2. The residential sealcoat application system of claim 1, wherein the towing member and towing receiver define a ball hitch towing connection, a three-point hitch connection or a drawbar hitch connection.

3. The residential sealcoat application system of claim 1, wherein the applicator member comprises a squeegee or a brush.

4. The residential sealcoat application system of claim 1, wherein the repositionable wheel assembly comprises a pair of wheels operably joined to a mounting member with a pair of extension members such that rotation of the driver accessible delivery lever to an application position causes said extension members to reside in a generally parallel orientation to the towable frame wherein the applicator member is positioned against the asphalt surface and the sealcoat reservoir is tilted so as gravity feed any sealcoat to a reservoir outlet port.

5. The residential sealcoat application system of claim 4, wherein rotation of the driver accessible delivery lever to a non-application position causes said extension members to reside in a generally perpendicular orientation to the towable frame such that the applicator member is positioned above the asphalt surface.

6. The residential sealcoat application system of claim 1, wherein the towing implement is selected from a group comprising: a lawn tractor and all-terrain vehicle.

7. The residential sealcoat application system of claim 1, wherein the distribution manifold is removably attached to the tow-behind sealcoat apparatus such that the distribution manifold is individually cleanable upon application of sealcoat to the asphalt surface.

* * * * *